United States Patent [19]

Unger et al.

[11] Patent Number: 4,791,835

[45] Date of Patent: Dec. 20, 1988

[54] DEVICE FOR INSTALLING OR REMOVING FLUORESCENT TUBES FROM LIGHTING FIXTURES

[75] Inventors: Henry M. Unger, Weston; Michael Vorobyov, Bethel, both of Conn.

[73] Assignee: Unger Licencing Ltd., Mount Vernon, N.Y.

[21] Appl. No.: 168,980

[22] Filed: Mar. 16, 1988

Related U.S. Application Data

[63] Continuation-in-part of Ser. No. 57,297, Jun. 1, 1987.

[51] Int. Cl.[4] ..... B25B 13/00

[52] U.S. Cl. ..... 81/53.12; 81/53.1; 81/53.11

[58] Field of Search ..... 81/53.1, 53.11, 53.12

[56] References Cited

U.S. PATENT DOCUMENTS 2,388,137 8/1988 Graumlich ..... 81/53.11

*Primary Examiner*—Frederick R. Schmidt
*Assistant Examiner*—Lawrence Cruz
*Attorney, Agent, or Firm*—Abelman Frayne Rezac Schwab

[57] ABSTRACT

A device for installing or removing fluorescent tubes from a lighting fixture has a cradle with drive rollers and has spring biased arms which move the drive rollers into frictional engagement with a fluorescent tube, subsequent to which the drive rollers can be rotated to rotate the fluorescent tube by rotating a pole carrying the device.

7 Claims, 4 Drawing Sheets

DEVICE FOR INSTALLING OR REMOVING FLUORESCENT TUBES FROM LIGHTING FIXTURES

This application is a continuation-in-part of parent application Ser. No. 057,297, filed June 1, 1987.

FIELD OF THE INVENTION

This invention relates to a device used for installing or removing fluorescent tubes from lighting fixtures located at elevated positions and out of arms reach of a person servicing the fixture. Such fixtures are usually at a considerable distance above the floor in stores, warehouses, workshops and the like, and are only accessible manually by the use of a step ladder, or, by the use of a power lift of the type commonly known as a cherry-picker.

BACKGROUND OF THE INVENTION

Many attempts have been made to provide a pole mounted device whereby fluorescent tubes can be installed and removed from lighting fixtures without the use of a step ladder by a person standing on a floor beneath a lighting fixture in conditions in which the lighting fixture is located several feet above that floor and out of arms reach of that person.

Fluorescent tubes commonly are provided with contact pins at their respective ends which must be properly positioned within spaced socket members carried by the lighting fixture. Thus the installation or removal of fluorescent tubes from lighting fixtures in such remote locations involves considerably more than providing a simple spring-loaded clamp at the end of a pole and which can be pushed upwardly to engage the fluorescent tube, to permit its installation or removal.

This must be accomplished in one of two ways, the first being in respect of fluorescent tubes provided with dual contact pins at their respective ends. Tubes of this type must be rotated through 90 degrees in order to properly position the contact pins within the respective socket members, or, in order to remove the pins and thus the fluorescent tube from the respective socket members.

The second way is in respect of fluorescent tubes provided with but a single contact pin at each of its ends. Tubes of this type must be moved axially of their longitudinal axis against spring-loaded contacts of the respective socket members in order to install or remove the fluorescent tube. Additionally, it is highly desirable that fluorescent tubes of this type be rotated, prior to removal and subsequent to installation, as there is a tendency of the pins to stick within the sockets due to the build-up of dust, dirt or other debris in the sockets.

Quick, U.S. Pat. No. 2,394,988 and Panzica, U.S. Pat. No. 2,819,922 teach devices for rotating a fluorescent tube of the first type about its longitudinal axis to permit installation or removal of such fluorescent tubes from a lighting fixture. Both Quick and Panzica teach a pole mounted device in which a spring loaded cradle is supported on the end of a pole in a manner permitting swinging movement of the cradle through an angle of 90 degrees from a position in which is extends transverse to the longitudinal axis of the pole, to a position in which it extends laterally of the pole axis.

However, such devices only can be employed in situations where there is sufficient free space laterally within the fixture or between adjacent fluorescent tubes in a multiple tube arrangement of fixture in order to accomodate the required lateral swinging movement of the cradle. This precludes the use of the device in tight spaces, and where a multiple array of fluorescent tubes is provided in closely spaced adjacent relationship within the lighting fixture.

This problem is eliminated by Switzer, U.S. Pat. No. 2,381,563 and Van Gerven, U.S. Pat. No. 3,776,584, both of which teach a device by which a fluorescent tube can be held and rotated about its longitudinal axis through 90 degrees without requiring movement of the cradle in directions laterally of the pole.

Switzer accomplishes this by providing a cradle having spring loaded arms that is fixedly held on the pole end against movement relative thereto, and by providing a friction roller engagable with the fluorescent tube, the friction roller being rotatable by means of a lever and ratchet arrangement which is actuated by a pull cord.

The operation of the Switzer device thus requires the use of two hands, one being required to hold the pole and steady it against movement, and the other being required to actuate the ratchet mechanism by pulling on the pull cord.

Van Gerven teaches a device which includes a spring-loaded cradle having friction belts for holding and rotating a fluorescent tube. The belts are driven to rotate the fluorescent tube through 90 degrees about its longitudinal axis by rotating a separate drive shaft arranged co-axially within the pole, a right-angled drive gearing being provided for this purpose.

Van Gerven is thus encumbered with the same problem as is Switzer, in that two hands are required for the manipulation of the device, one for holding the pole steady and the other for rotating the drive shaft contained within the pole.

SUMMARY OF THE INVENTION

The present invention proceeds from these prior teachings, and provides a device for installing or removing fluorescent tubes from a lighting fixture which can be held and manipulated by but a single hand, thus leaving the other hand free for other uses, including its use in the additional stabilization of the pole while inserting or removing a fluorescent tube.

According to the present invention, a cradle is positioned at one end of the pole and extends transverse to the longitudinal axis of the pole, the cradle being journalled on the pole end in a manner permitting rotation of the pole about the longitudinal axis of the pole to the exclusion of angular movement laterally of the longitudinal axis of the pole. Preferably, a friction washer or other suitable friction member is interposed between the pole and the cradle, such that rotation of the pole will cause a corresponding rotational movement of the cradle in the event that the cradle is free to so move, thus enabling the device to be aligned axially with a fluorescent tube to be removed from a fixture, or in the alternative to move a fluorescent tube into correct relationship for insertion into the fixture.

The cradle is preferably journalled on a cylindrical post fast with the pole and which extends co-axially thereof, the cylindrical post being fixed to the pole for rotation in unison with the pole.

The cylindrical post extends through a journal bearing fast with the cradle, and terminates at its free end in one of a pair of right-angle gears.

The other of the pair of gears is fast with a shaft extending longitudinally of the cradle and transverse to the axis of the pole, the shaft being supported for rotation in bearings carried by the cradle. Rollers of a crepe rubber material are mounted on the shaft for rotation in unison therewith, the rollers providing drive members for rotating a fluorescent tube when that tube is positioned within the cradle.

Opposed spring loaded arms are pivotally mounted on the cradle at its opposite ends, and are biased toward each other, the respective arms carrying rollers mounted for rotation about axes parallel to the longitudinal axis of the shaft carrying the drive rollers.

In use of the device to remove a fluorescent tube from a fixture, the device is moved upwardly towards the fluorescent tube, and, the pole is then rotated to align the rollers carried by the arms of the device with the length of the fluorescent tube.

The device is then pushed gently upwardly to cause the rollers carried by the spring loaded arms to ride over and around the fluorescent tube, the arms moving against their associated spring bias to permit this movement and subsequent closing of the arms about the fluorescent tube to bias the fluorescent tube into engagement with the crepe rubber drive rollers.

This will occur as a "snap-on action" of the device, at which time the fluorescent tube and the device will become firmly attached one to the other.

After positioning of the device in surrounding relationship with the fluroescent tube, the pole is then rotated by the use of the same hand as the one holding the pole, this in turn causing rotation of the cylindrical post, and in turn of the gears, and in turn of the shaft carrying the drive rollers, and finally rotation of the fluorescent tube itself.

At the time the contact pins of the fluorescent tube become aligned with the slots of the socket members of the fixture, the fluorescent tube will move downwardly under its own weight and that of the device and the pole, and, can be safely removed from the lighting fixture, the fluorescent tube at that time being firmly and securely held within the cradle against axial movement of the fluorescent tube by the frictional engagement of the crepe rubber drive rollers with the exterior of the fluorescent tube, and by the rollers carried by the spring loaded arms.

The reverse procedure is followed in installing a replacement fluorescent tube, this involving inserting a fluorescent tube into the cradle, by then moving the device upwardly to position one of the pins at the opposite ends of the fluorescent tube within the slot of the associated socket member, by then rotating the pole to align the others of the pins of the fluorescent tube within the slot of the associated socket member, by then moving the device and the fluorescent tube upwardly to fully position both of the pins at the respective ends of the tube within the associated slot of the socket member, and by then rotating the pole to rotate the fluorescent tube through 90 degrees and into its finally installed position.

The device can then be removed from the fluorescent tube by gently pulling the pole downwardly, thus causing the arms of the device to move away from each other against their spring bias, and the rollers carried by those arms to ride over and off the fluorescent tube.

The spring biased arms can be of minor width, this permitting them easily to pass between the fluorescent tube and other fluorescent tubes positioned adjacent thereto, or, for them readily to be inserted into a fixture of the single tube type, and which is of relatively deep and narrow construction.

In the event that the device is to be employed in installing or removing fluorescent tubes of the single pin type, the same procedures are followed in order to install the device over the fluorescent tube, and then to rotate the fluorescent tube to "break" frictional contact between the pins of the tube and the socket. The pole is then moved laterally to disengage the pin at one end of the fluorescent tube from its socket, and is then moved laterally in the opposite direction to remove the tube completely from the fixture. During these lateral movements of the pole, the crepe rubber friction rollers securely hold the tube within the device against axial displacement, thus inhibiting slippage of the device relative to the tube and longitudinally thereof.

During movement of the fluorescent tube towards or away from the associated lighting fixture, the tube thus is positively held against slippage relative to the device,-thus insuring that the fluorescent tube is not dropped either on the head of the user or adjacent the users person, with consequential splintering of the glass tube, and also, exposure of the user to the toxic chemicals employed in the manufacture of such fluorescent tubes.

Preferably, the pole, the cylindrical post, the driven shaft, the cradle and the spring biased arms each are formed from a light-weight metal alloy, thus reducing the effort to be exerted by the user during the removal of a spent fluorescent tube and its replacement by a fresh tube.

DESCRIPTION OF THE ACCOMPANYING DRAWINGS

The invention will now be described with reference to the accompanying drawings, in which, FIG. 1 is a perspective view illustrating the manner of use of the device;

DESCRIPTION OF THE PREFERRED EMBODIMENT

Figure 1:
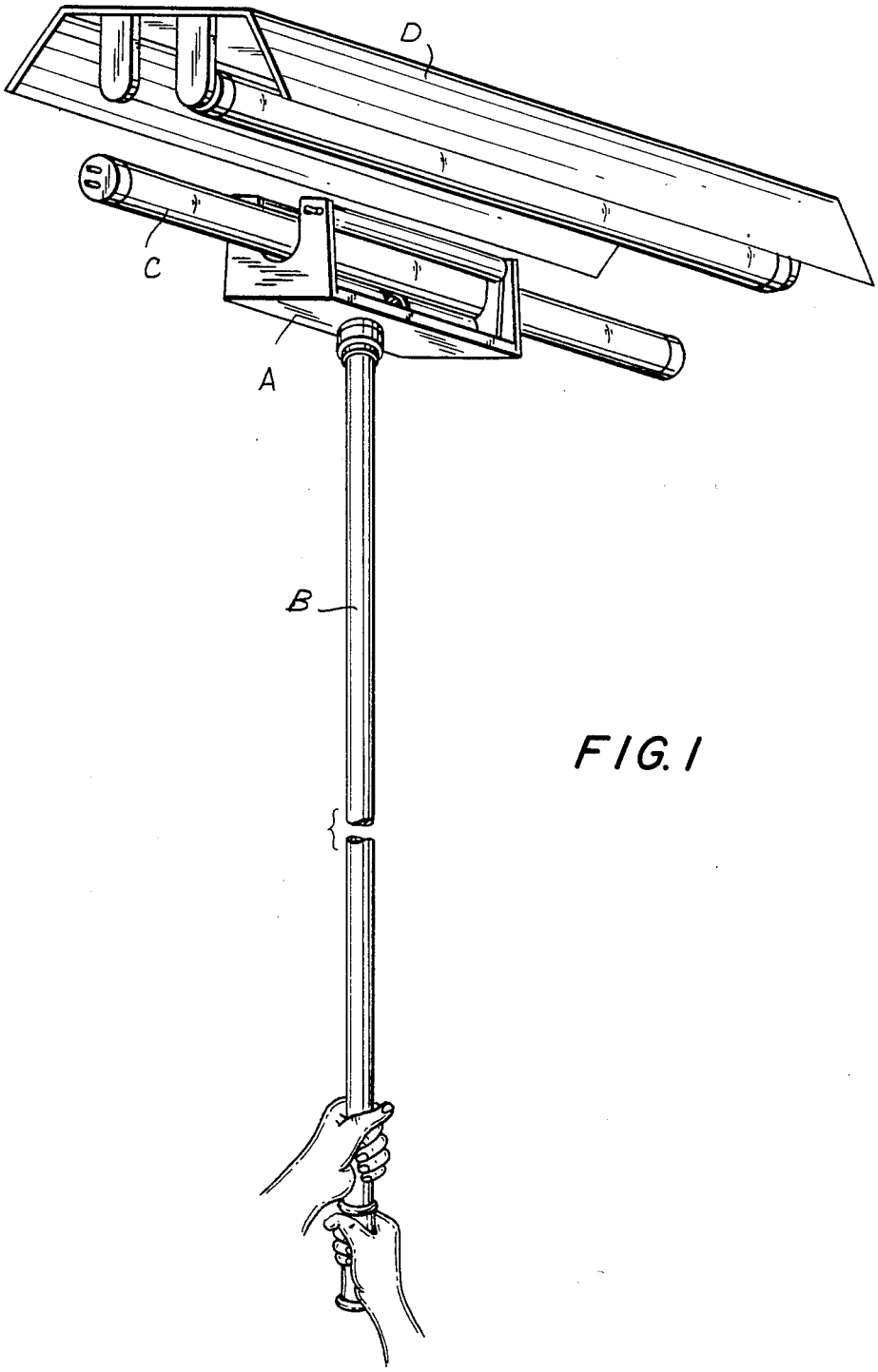

Referring now to FIG. 1 of the drawings, this illustrates the device generally at A, the device A being mounted on a pole B, and holding a fluorescent tube C, which either is in the process of removal from a lighting fixture D, or, in the process of being inserted into the lighting fixure D.

The pole B, of course, is hand-held and must be manipulated with a degree of dexterity in order to insert the tube C into the lighting fixture D, it being contemplated that the pole B may be as much as twelve feet or more long. Typically, a telescopically extensible pole will be employed of the type commonly used by professional painters, and, which is provided with a socket at its upper end in which the device of the present invention is held and positioned, the device being more clearly illustrated in FIGS. 2, 3, and 4 of the drawings.

Figure 2:
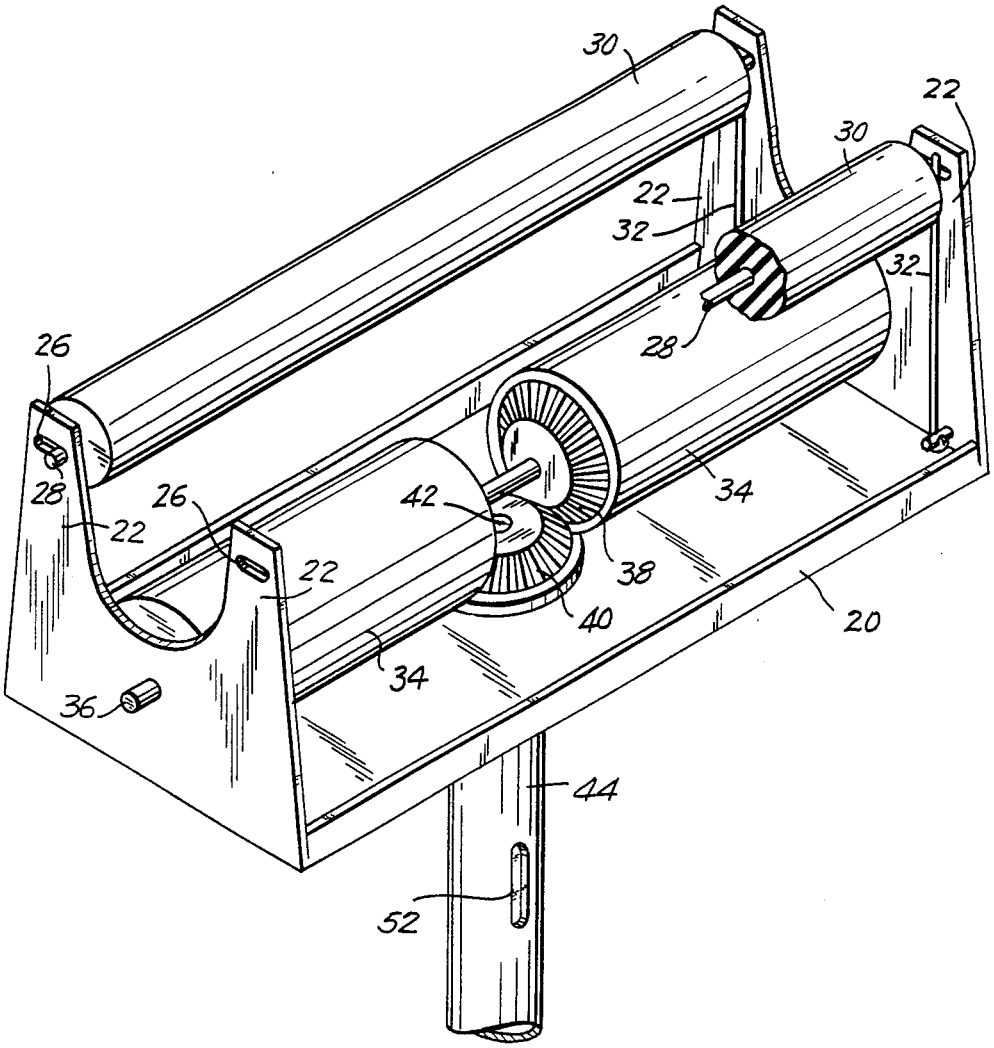
FIG. 2 is a fragmentary perspective top view of the device.
Figure 3:
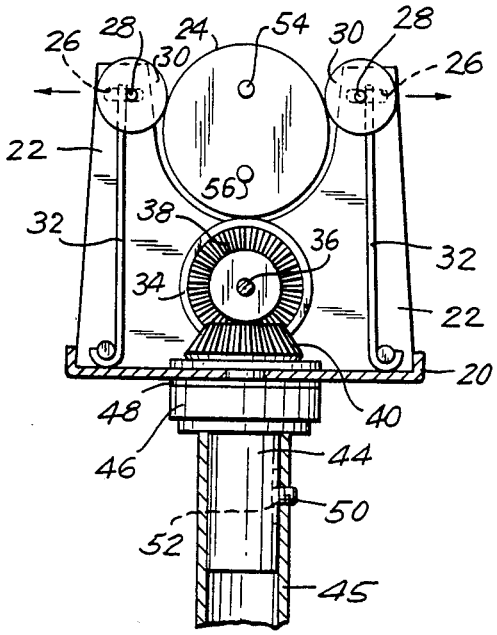
FIG. 3 is a vertical cross-section view of the device.
Figure 4:
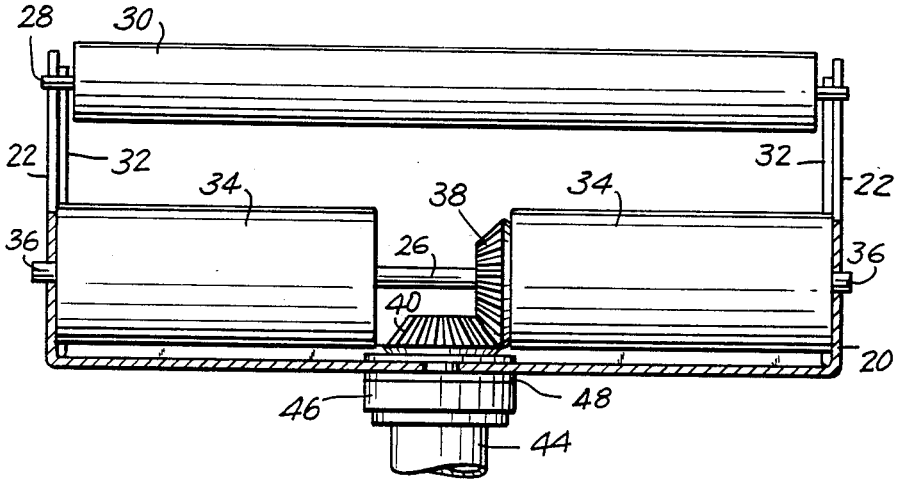
FIG. 4 is a sectional front elevation of the device.

Referring now to FIG. 2, the device includes a cradle 20 having upstanding arms 22 at each of its opposite ends, the respective arms 22 being of U-form configuration, and being spaced from each other by a distance sufficient to accomodate a fluorescent tube 24, when inserted into the device as illustrated in FIG. 3.

At their upper ends, the arms 22 are provided with elongate slots 26 through which pivot rods 28 extend, the respective pivot rods 28 carrying rollers 30 formed from a rubber-like material. The respective pivot rods 28 are freely slidably within the slots 26, and are biased towards each other by springs, which conveniently are piano wire springs 32.

Positioned directly beneath the rollers 30, and intersecting the distance between those rollers, are drive rollers 34, preferably formed form a crepe rubber material having the capability of shedding its outer surface, the respective drive rollers being mounted for rotation in unison with a shaft 36 journalled for rotation in the end walls of the cradle 20.

Preferably the material from which the rollers is formed is a crepe rubber having the characterstic of shedding its outer surface in the manner of a pencil eraser, such that the outer surface of the roller is self cleaning and remains substantially uncontaminated by dust or dirt which may have settled on a fluorescent tube to be removed from the lighting fixture. Such crepe rubber materials are well-known in the art.

Fixed to the shaft 36 is a mitre gear 38, the mitre gear meshing with a mitre gear 40 in order to provide a right-angled drive gearing.

Thus, and as is later discussed, upon rotation of the gear 40, the gear 38 is rotated, as is the shaft 36 and the crepe rubber drive rollers 34 mounted on that shaft.

If, as is illustrated in FIG. 3, a fluorescent tube 24 has been inserted into the device, or, the device has been positioned over a fluorescent tube located within a lighting fixture, then, rotation of the gear 40 will in turn cause rotation of the fluorescent tube 24 about its longitudinal axis for the purpose of moving the contact pins into a position permitting insertion of the fluorescent tube into the associated lighting fixture or removal therefrom.

The mitre gear 40 is fast with a shaft 42, which extends downwardly through the cradle 20, and which is rigidly attached to a pole 44. The pole 44 is of any convenient form, and, includes a connector at its end whereby the shaft 42 can be rigidly connected to the pole.

The manner of attaching the shaft 42 to the pole forms no part of this invention, other than in respect that the shaft 42 must be fixidly attached to the pole for rotation in unison with the pole and against rotation relative to the pole and the shaft 42 must be rotatable relative to the cradle 20.

Conveniently, this can be arranged by having the cradle 20 trapped beneath the bevel gear 40 and held against a circular boss 46 fast with the shaft 44. In order to partially restrict freedom of movement of the cradle 20 relative to the shaft 44, preferably, a friction washer 48 or other similar member is positioned between the boss 46 and the cradle 20, the friction washer being sufficiently tight as to cause rotation of the shaft 44 and the cradle 20 in unison when no force is applied to the cradle resisting such movement, and, sufficiently loose that the shaft 44 and the crown gear 40 can rotate relative to the cradle with comparative freedom at the time the cradle is held against such movement, which will be caused either by a fluorescent tube positioned within a fixture, or, by the engagement of a fluorescent tube with the fixture at the time that tube is being inserted into the fixture.

Conveniently, the shaft 44 can be fixedly secured to the pole 45 by means of a grub screw 50 having its end received within a socket 52 in the shaft 44.

The use of the device will now be described with reference to FIGS. 1 and 3.

If the fluorescent tube 24 is to be inserted into a lighting fixture, the fluorescent tube 24 is manually inserted into the device in the position illustrated in FIGS. 1 and 3. The bias of the springs 32 acting on the roller shaft 28 supporting the rollers 30 then acts to move the rollers 30 towards each other, and in so doing, to move the fluorescent tube downwardly into frictional gripping relationship with the drive rollers 34.

The fluorescent tube 24 is thus firmly held within the device and is incapable of slippage in a direction longitudinally of the fluorescent tube, by virtue of the frictional grip exerted by the rollers 30 and 34.

The cradle 20 itself is at this time frictionally held by the friction washer 48, such that manual rotation of the pole 45 will cause a corresponding movement of the cradle 20, thus allowing the fluorescent tube 24 to be readily brought into its correct orientation with respect to the sockets of the lighting fixture.

The uppermost pin 54 at the end of the fluorescent tube 24 is then inserted into the slot of the end socket of the lighting fixture. So doing will prevent any further movement of the cradle 20 in unison with the pole, i.e., insertion of one of the pins of the fluorescent tube into the associated socket of the fixture will automatically establish the drive to the drive rollers 34.

In the event that the lower pin 56 of the fluorescent tube is at that time oriented other than in vertical alignment with the upper pin 54, then, rotation of the shaft 44 by rotation of the pole 45 will cause rotation of the bevel gear 40, the cradle 20 itself being held stationary. This in turn, will cause rotation of the bevel gear 38, and, rotation of the shaft 36 and the drive rollers 34 carried by that shaft.

Thus, rotation of the pole in an appropriate direction will move the pins 54 and 56 of the fluorescent tube into their correct vertical orientation. Once that is accomplished, then, the device and the fluorescent tube can be pushed upwardly to position both of the pins 54 and 56 correctly within their sockets, subsequent to which the pole 45 can be given a partial turn through 90 degrees to move the pins 54 and 56 of the fluorescent tube 24 from their vertical alignment as illustrated in FIG. 3 and through 90 degrees into a horizontal plane, at which time the fluorescent tube will be correctly inserted into its end sockets.

Once this has been done, then, the device of the present invention easily can be removed from the fluorescent tube merely by pulling gently down on the pole. This will cause the rollers 30 to retract away from each other against the bias of the springs 32 will cause the rollers to pass over the outer periphery of the fluorescent tube 24, thus completely freeing the device from the fluorescent tube 24.

If the device is to be employed to remove a fluorescent tube that is already in situ in a lighting fixture, as is illustrated in FIG. 1, then the device of the present invention is passed upwardly towards the fluorescent tube, the pole 45 is rotated to bring the rollers 30 into substantial alignment with the fluorescent tube 24, and, the pole 45 is then gently pushed upwardly. Thus causes retraction of the rollers 30, and, the positioning of the fluorescent tube 24 between the rollers 30 and the drive rollers 34. Then, by appropriately turning the pole 45, the bevel gears 40 and 36 will be rotated as will be the drive rollers 34, to rotate the fluorescent tube 24 and bring its pins 54 and 56 into vertical alignment for withdrawal of the flourescent tube from the fixture. As the fluorescent tube is at that time firmly held by the rollers 30 and 34, it cannot slip out of the device.

Exactly the same procedures are adopted in the event that the fluorescent tube 24 is of the type having a single pin at its respective ends.

In order to insert such a tube, the fluorescent tube 24 is manually inserted into the device and is then presented to the lighting fixture, the pin at one of the ends of the fluorescent tube being appropriately inserted into one of the sockets of the lighting fixture, subsequent to which the pole 45 is pushed laterally towards that socket, and, the pin at the opposite end of the fluorescent tube 24 is brought into position for engagement with the socket at the opposite end of the lighting fixture. At that time, lateral pressure on the pole 45 is discontinued, to allow the spring contacts of the respective sockets to center the tube in the fixture, the fluorescent tube being at that time securely held and positioned by the lighting fixture.

At this point, it invariably occurs that the fluorescent tube 24 needs to be rotated within the fixture in order to bed down the pins at the ends of the tube and the contacts of the sockets and ensure good elecrtrical continuity. This easily is accomplished merely by rotating the pole 45 and in turn rotating the tube 24, thus assuring good electrical pin-to-contact engagement, subsequent to which the device is removed from the fluorescent tube in the manner previously discussed.

In the event that a fluorescent tube 24 having a single pin at its ends is to be removed from a fixture, this is accomplished in exactly the reverse manner. Firstly, the device of the invention is positioned over the tube 24. The pins at the opposite ends of the tube 24 may, however, at that time have become welded to their associated contacts, or, the sockets may have been contaminated with dirt, dust or other debris which causes the pins to stick within the sockets. Any such restraints can be broken by rotating the tube 24 about its longitudinal axis, merely by rotating the pole 45, subsequent to which a lateral push is exerted on the pole 45 to remove one of the pins from its socket, and, an opposite pull is then exerted on the pole 45 to withdraw the tube 24 from the lighting fixture.

As will readily be appreciated, various modifications may be made in the device discussed above without departing from the scope of the present invention as defined in the appended claims. For example, the cradle 20 itself may be made considerably narrower than that illustrated, in order to decrease its bulk and weight, and, different arrangements can be made for providing the necessary inward spring bias on the rollers 30. For example, instead of being mounted in fixed arms 22 associated with the cradle 20, the arms 22 equally well could be pivotally mounted on the cradle 20, and the arms themselves spring biased in order to exert the required force on the rollers 30. Further, any form of right-angled gearing can be employed in substitution for the bevel gears 38 and 40, and, various other manners of providing frictional restraint against rotation of the cradle 20 relative to the crown gear 40 can be provided, or, if desired, the frictional restraint can be omitted in its entirety, the frictional restaint being provided more particularly as a matter of convenience in preventing unwanted swinging movement of the cradle during the handling of the device, and serving no other function.

Figure 5:
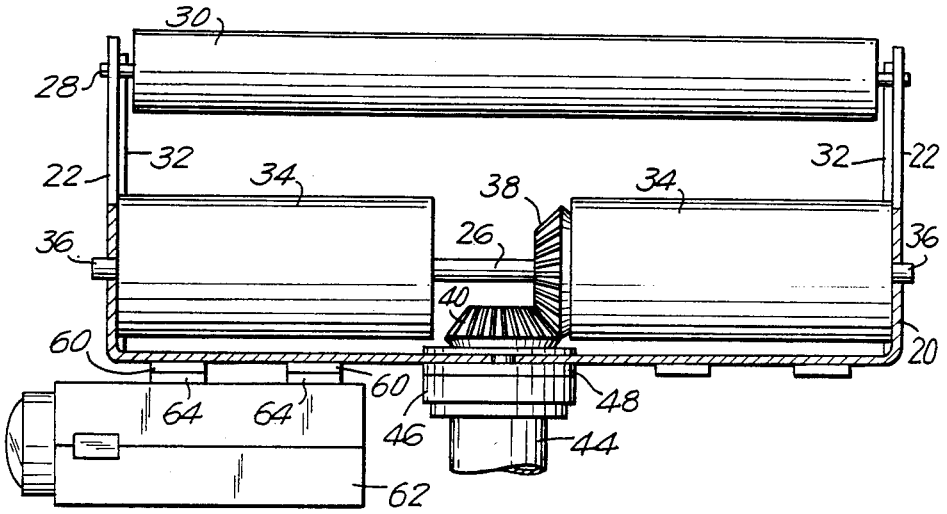
FIG. 5 is a view similar to FIG. 4, and showing an addition thereto.

As illustrated in FIG. 5, the underside of the cradle 20 can be provided with adhesive strips 60, to provide for the attachment of a convention flashlight 62 having complimentary adhesive strips 64, thus facilitaing use of the device in poorly lit locations.

Figure 6:
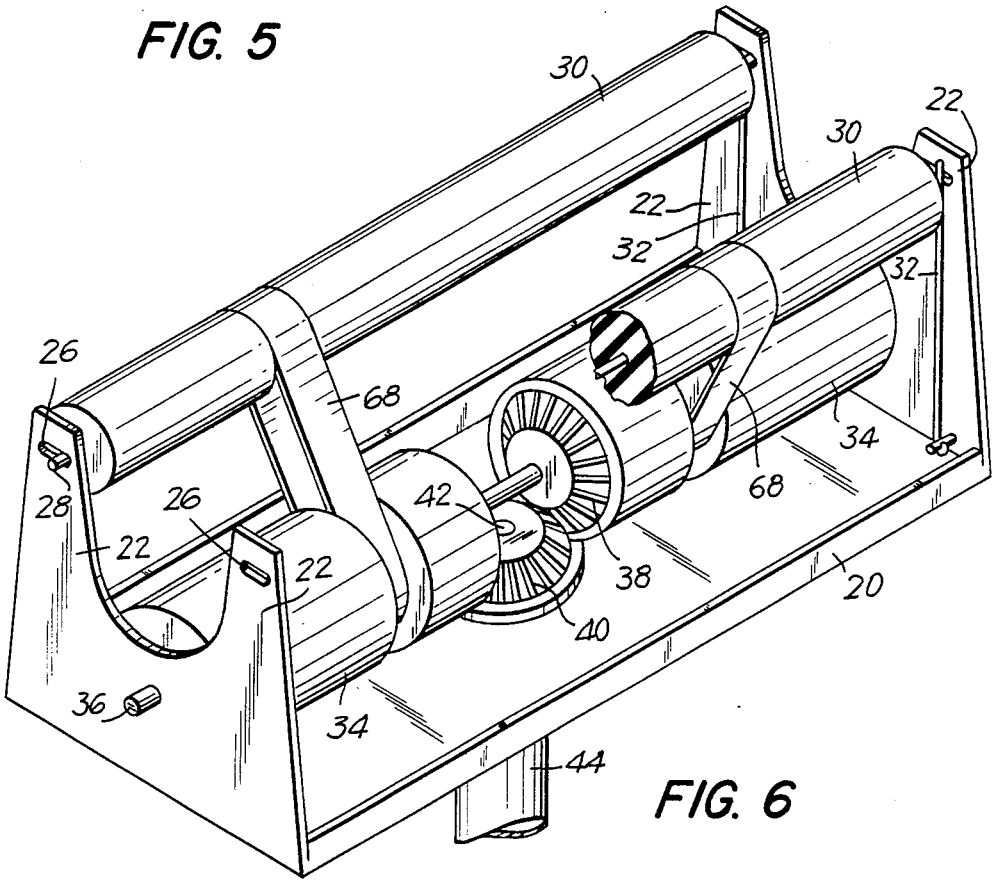
FIG. 6 is a view similar to FIG. 2, and showing a modification thereof.

Further, and as illustrated in FIG. 6, drive belts 68 of a stretchable rubberlike material can be provided between the drive rollers 34 and the gripping rollers 30, the belts 68 being recessed into the respective rollers 34, 30 on radii such that rotation of the rollers 34 will produce a substantially identical peripheral rotational speed of the respective rollers 30 and linear speed of the belts 68 in gripping relation with a flourescent tube located within the cradle 20 in order to further assist removal of the tube from its fixture, or its installation therein.

We claim:

1. A device for use in installing and removing fluorescent tubes from a lighting fixture, comprising:

a cylindrical post having means for rigidly attaching said cylindrical post to a pole;

a cradle journalled on said cylindrical post for relative rotational movement between said post and said cradle;

a gear rigidly affixed to said post at an end thereof extending through said cradle;

a complimentary mating gear rigidly affixed to a shaft journalled for rotation in said cradle and having its axis extending perpendicular to the longitudinal axis of said cylindrical post;

frictional drive rollers rigidly affixed to said shaft for rotation in unison therewith;

means carried by said cradle for detachably holding a fluorescent tube within said cradle and in frictional engagement with said drive rollers; and friction producing means interposed between said cylindrical post and said cradle, said friction producing means permitting rotation of said post relative to said cradle when said cradle is held against rotational movement and promoting rotational movement of said cradle in unison with rotational movement of said post when said cradle is freed from rotational restraint;

whereby, at the times said cradle is rotationally restrained, rotation of said cylindrical post and said pole will produce rotational movement of said frictional drive rollers about their longitudinal axis, and will in turn produce rotational movement of said fluorescent tube about its longitudinal axis within said cradle.

2. The device of claim 1, in which said gears are mating bevel gears.

3. The device of claim 1, further including friction illumination means detachably fixed to said cradle.

4. The device of claim 1, in which said frictional drive rollers are formed from a crepe sponge rubber capable of shedding its outer surface.

5. The device of claim 1, including plural frictional drive rollers positioned on said shaft and rigidly affixed thereto, said frictional drive rollers being positioned spaced from said gears.

6. The device of claim 1, in which said means carried by said cradle for holding a fluorescent tube positioned within said cradle include rollers carried by said cradle and moveable relative thereto, and which are biased towards each other by springs.

7. The device of claim 6, further including drive belts driven by said drive rollers and interconnecting driver rollers and the respective said spring biassed rollers, said belts being recessed into the peripheries of the associated rollers and being resiliently stretchable for them to frictionally engage around the periphery of a flourescent tube positioned in said cradle.

* * * * *